United States Patent [19]

Grecksch

[11] Patent Number: 4,890,799

[45] Date of Patent: Jan. 2, 1990

[54] APPARATUS FOR REMOVING A TUBE FROM A TUBE MAGAZINE AND FOR TRANSFERRING THE TUBE TO THE CREEL OF A WINDING STATION

[75] Inventor: Hans Grecksch, Mönchen-Gladbach, Fed. Rep. of Germany

[73] Assignee: W. Schlafhorst & Co., Mönchen-Gladbach, Fed. Rep. of Germany

[21] Appl. No.: 202,826

[22] Filed: Jun. 3, 1988

[30] Foreign Application Priority Data

Jun. 6, 1987 [DE] Fed. Rep. of Germany ..... 3719025
Aug. 8, 1987 [DE] Fed. Rep. of Germany ..... 3726508

[51] Int. Cl.[4] ..... B65H 67/04; B65H 54/20

[52] U.S. Cl. ..... 242/35.5 A; 242/18 DD; 242/18 PW

[58] Field of Search ..... 242/35.5 A, 35.5 R, 242/56 R, 18 R, 18 DD, 18 PW; 57/270, 275

[56] References Cited

U.S. PATENT DOCUMENTS 4,139,108 2/1979 Kamp et al. ..... 242/35.5 A X
4,154,411 5/1979 Kamp et al. ..... 242/35.5 A X
4,352,466 10/1982 Baumges et al. ..... 242/35.5 A X
4,399,951 8/1983 Preuhs ..... 242/35.5 A X
4,598,881 7/1986 Lattion ..... 242/35.5 A
4,638,956 1/1987 Wey ..... 242/35.5 A

FOREIGN PATENT DOCUMENTS 0110275 6/1984 European Pat. Off. ..... 242/35.5 A
0198517 10/1986 European Pat. Off. .
2133172 1/1972 Fed. Rep. of Germany .
2528222 1/1977 Fed. Rep. of Germany .
2640312 3/1978 Fed. Rep. of Germany .
2816418 10/1979 Fed. Rep. of Germany ..... 242/35.5 A
3334777 4/1984 Fed. Rep. of Germany .
3340497 5/1985 Fed. Rep. of Germany .

*Primary Examiner*—Stanley N. Gilreath
*Attorney, Agent, or Firm*—Herbert L. Lerner; Laurence A. Greenberg

[57] ABSTRACT

A cheese or cross-wound bobbin producing machine has winding stations with creels. An assembly includes a tube magazine and an apparatus disposed on a movable service carriage for removing a tube from the tube magazine and transferring the tube to a creel. The apparatus includes a feeder having individual fingers being mutually spaced apart along the longitudinal axis of the tube. The individual fingers encompass the tube therebetween, move transversely to the longitudinal axis of the tube, and move between the tube magazine and the creel.

23 Claims, 8 Drawing Sheets

APPARATUS FOR REMOVING A TUBE FROM A TUBE MAGAZINE AND FOR TRANSFERRING THE TUBE TO THE CREEL OF A WINDING STATION

The invention relates to an apparatus on a movable service carriage of a machine that produces cross-wound bobbins or cheeses, for removing an empty bobbin tube from, a tube magazine and for transferring the tube to the creel of a winding station of the machine producing the cheeses, with the aid of a feeder that is movable between the tube magazine and the creel.

Automatic cheese winding equipment and rotor spinning machines conventionally include cheese changers in which the tubes are received from a trough-shaped feeder and held by a bracing wire. The trough-shaped feeder is firmly connected to a pivotable feeder arm.

A disadvantage of a feeder apparatus of this kind is that in order to adjust to the tube diameter and the tube conicity, the trough-shaped feeder must be pivoted in the room. A further disadvantage is that it is difficult to manipulate tubes provided with partial windings having different sizes. It is also difficult, with a rigid, relatively large trough-shaped feeder, to manipulate the tubes at all, and to remove them from the tube magazine and transfer them to the creel without difficulty. To do so, resilient flaps on the bottom of the tube magazine are necessary, and the cheese changer must be provided with barrier wires that prevent the tubes in the magazine from temporarily sliding after those that have been removed. The barrier wires must be controllable, and costly tube magazines are required at each winding station or work station of the machine producing the cheeses.

It is accordingly an object of the invention to provide an apparatus for removing a tube from a tube magazine and for transferring the tube to the creel of a winding station, which overcomes the hereinafore-mentioned disadvantages of the heretofore-known devices of this general type, which manipulates the tubes quickly and securely with simple means that are adjustable to variously dimensioned tubes, and which reequips the winding stations with tubes without difficulty.

With the foregoing and other objects in view there is provided, in accordance with the invention, in a cheese or cross-wound bobbin or cheese producing machine having winding stations with creels, an assembly comprising a tube magazine and an apparatus disposed on a movable service carriage for removing a tube from the tube magazine and transferring the tube to a creel, the apparatus including a feeder having individual fingers being mutually spaced apart along the longitudinal axis of the tube, means for encompassing or grasping the tube between the individual fingers, means for moving the individual fingers transversely to the longitudinal axis of the tube, and means for moving the individual fingers between the tube magazine and the creel.

In accordance with another feature of the invention, the individual fingers include at least one separate finger and opposing fingers associated with the at least one separate finger.

In accordance with a further feature of the invention, the at least one or a pair of the individual fingers is associated with the head portion and at least one of the individual fingers is associated with the base portion of the tube.

In accordance with an added feature of the invention, there are provided finger holders in which the individual fingers are inserted, and means for alternately permitting longitudinal displacement and locking of the individual fingers in the finger holders.

In accordance with an additional feature of the invention, the individual fingers have a graduation thereon relating to at least one of tube diameter values and/or tube conicities.

In accordance with yet another feature of the invention, there are provided two oppositely or contrarily rotatable finger shafts on which the individual fingers are disposed in groups, a feeder head in which the finger shafts are supported, and a pivotable feeder arm of the feeder in which the feeder head is rotatably supported.

In accordance with yet a further feature of the invention, the individual fingers include two pairs of fingers respectively facing one another transversely to the longitudinal axis of the tube and at least one other finger, the two pairs of fingers being disposed on one of the two finger shafts for encompassing the tube at the tube base and at the tube head from one side, and the at least one other finger being disposed on the other of the two finger shafts for encompassing the middle portion of the tube from the opposite side.

In accordance with yet an added feature of the invention, there is provided a articulating finger tips disposed on the individual fingers.

In accordance with yet an additional feature of the invention, the finger tips have shapes selected from the group consisting of plate-like, dish-like and bowl-like shapes.

In accordance with still another feature of the invention, the tube magazine includes two mutually spaced apart tube carrying arms defining storage positions including a front tube storage position, the transverse moving means imparting a path of motion to at least one of the individual fingers of the feeder extending upwardly or from bottom to top past the tube carrying arms through the front tube storage position.

In accordance with still an added feature of the invention, there are provided means for adjusting at least one of the two tube carrying arms of the tube magazine to place at least a tube in the front tube storage position in a predetermined axial position, regardless of whether the tube is cylindrical or has a conicity.

In accordance with still an additional feature of the invention, the adjusting means includes an adjusting scale for at least one of the tube carrying arms being calibrated for at least one of tube diameter and given tube conicity.

In accordance with again another feature of the invention, the apparatus includes a cheese changer having a creel raising device and/or a creel lowering device.

In accordance with again a further feature of the invention, the the creel has two arms, the apparatus includes a cheese changer having a creel raising device for raising the creel into a tube receiving position, a stop device for the creel movable between a position of repose and an operating position, and a creel tilting lever for one of the arms of the creel to be pressed against the stop device.

In accordance with again an added feature of the invention, the apparatus includes a cheese changer having a device for forming a reserve winding on a tube end, and the feeder has a detent for holding the individual fingers in a tube receiving position, and a detent for holding the individual fingers in a tube releasing position, and a detent for holding the individual fingers in an intermediate position for forming a reserve winding, and the tube encompassing means opens and subsequently closes the individual fingers in the intermediate position.

In accordance with again an additional feature of the invention, the longitudinal axis of the tube received and retained by the feeder and the axial position of the tube predetermined by the tube magazine extend parallel to one another.

In accordance with another feature of the invention, the longitudinal axis of the device for forming a reserve winding and the axial position of the tube predetermined by the tube magazine extending parallel to one another.

In accordance with a further feature of the invention, the creel has a fastening axis in the tube receiving position, and the fastening axis and the axial position predetermined by the tube magazine extend parallel to one another.

In accordance with an added feature of the invention, the creel has a fastening axis in the tube receiving position, and the fastening axis and the longitudinal axis of the device for forming a reserve winding extend parallel to one another.

In accordance with a concomitant feature of the invention, the creel has a fastening axis in the tube receiving position, and the fastening axis and the longitudinal axis of the tube predetermined by the feeder extend parallel to one another.

Advantageous further features of the invention will become apparent from the dependent claims.

The apparatus according to the invention is very adaptable and reliable. Its advantages become especially important if the tube must be initially released in an intermediate position, so that a reserve winding can be applied.

Other features which are considered as characteristic for the invention are set forth in the appended claims.

Although the invention is illustrated and described herein as embodied in an apparatus for removing a tube from a tube magazine and for transferring the tube to the creel of a winding station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
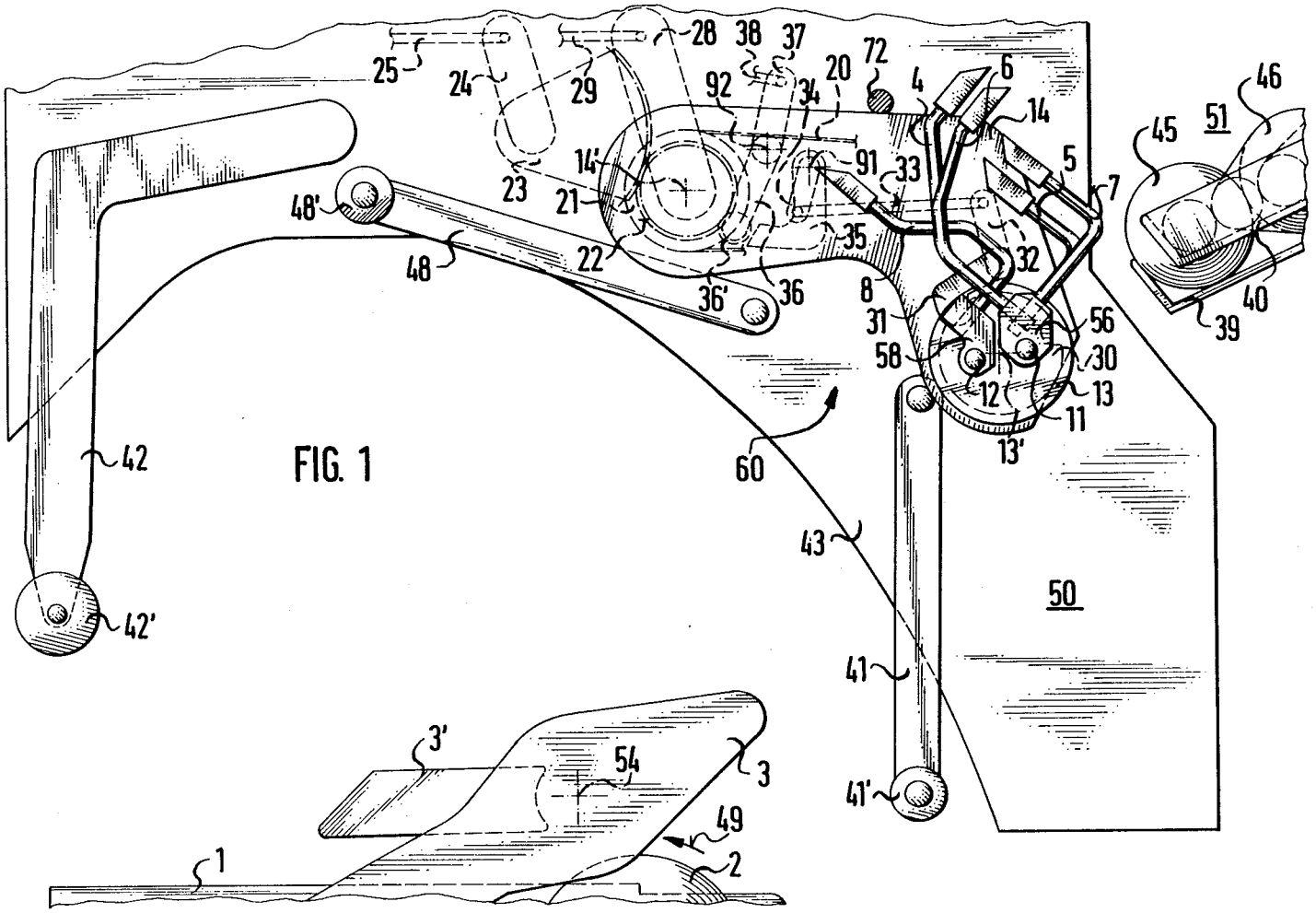
FIG. 1 is a fragmentary, diagrammatic, elevational view showing parts of a winding apparatus and a cheese changer

Referring now to the figures of the drawings in detail and first, particularly, to FIG. 1 thereof, there is seen a winding apparatus 1 of an automatic cheese, cross-wound bobbin or package winding unit, having a winding drum 2 which frictionally drives a tube, such as a tube for a cheese, cross-wound bobbin or package wound on the tube. The winding drum 2 rotates in the direction of an arrow 49. The winding drum 2 may be provided with a reversing thread groove, for applying the yarn to be wound in a cross-winding or back-and-forth manner. The tube is fastened in a creel 3 in a conventional manner. The creel 3, which is better seen in FIG. 6, has an axis of rotation located at reference numeral 52. The creel 3 also has a pivot axis 53, so that it can adapt to hold cylindrical or conical bobbins or tubes. The creel 3 is two-armed, but only the left arm is shown in the drawings. The right arm is of the same size and is additionally provided with a creel tilting lever 3', which will be described in further detail below. The fastening axis of the tube to be fastened in place in the creel 3 is shown at reference numeral 54. The fastening of the tube is accomplished in a conventional manner, by pivoting one of the two creel arms out of the way, then inserting the tube between rotatable tube plates and firmly holding the tube with the creel arm as this arm pivots back to the original position. As the cheese grows in size, the creel 3 pivots upward about the pivot axis 52.

According to FIG. 1, a cheese which has been completely wound has already been removed from the winding apparatus 1 by a cheese changer 50, in the form of an apparatus disposed on a movable carriage for removing a tube from a tube magazine and transferring the tube to a creel. The winding apparatus 1 is therefore ready to receive a new tube.

FIG. 1 shows a machine frame 43 of the automatic cheese changer 50 above the winding apparatus 1. During its activity on the winding apparatus 1, the cheese changer 50 is locked in place in a conventional manner and is thus prevented from further travel.

A feeder 60 with a pivotable feeder arm 14 having a feeder head 13 rotatably supported on the feeder arm, may be seen on the cheese changer 50. The feeder head 13 is rotatable about an axis of rotation 13' and the feeder arm 14 is rotatable about a pivot axis 14'.

The feeder head 13 has a total of five individual fingers 4- 8. The feeder head 13 is shown with the fingers and further actuating elements in particular detail in FIG. 2.

FIG. 1 also shows a tube magazine 51 which is suspended in stationary fashion from the machine superstructure of the winding apparatus 1 and has two tube carrying arms or magazine rails 39 and 40. The tube magazine 51 contains a plurality of empty tubes. Empty tubes 45 and 46 are shown in FIG. 1 and empty tubes 45, 46 and 47 are shown in FIG. 4.

Figure 4:
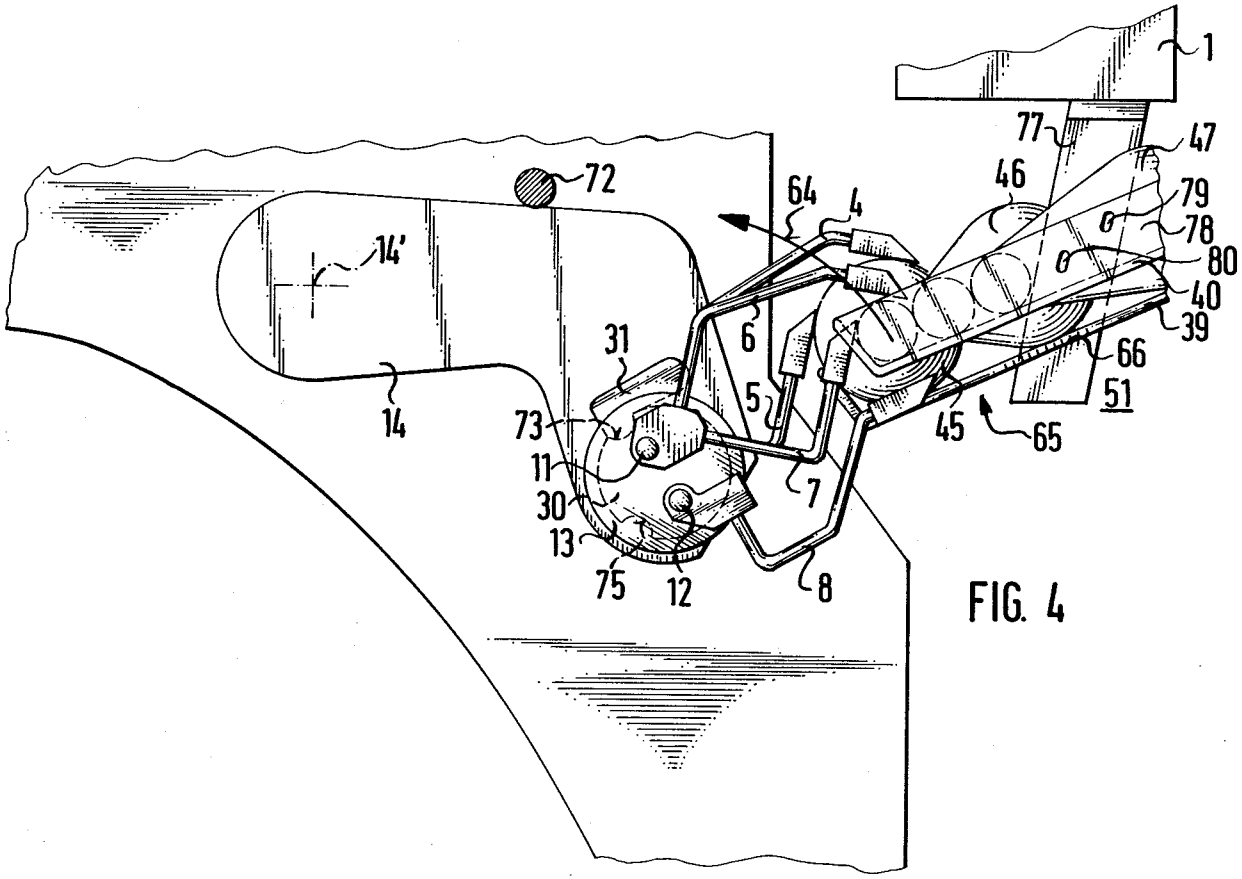

FIG. 4, in particular, shows that the tube carrying arm 39 is adjustably secured on a carrier 77. The carrier is in turn secured on a portion of the frame of the winding apparatus 1, which is shown in FIG. 4 above the carrier 77. Adjustment of the tube carrying arm 39 is accomplished by a combination of screws and oblong slots along an adjusting scale 66. The fastening means are covered by the tube 47 in FIG. 4. The other tube carrying arm 40 is secured on a carrier in the same manner. For the sake of better illustration of the tube magazine 51, the other carrier has been removed. Oblong fastening slots 79 and 80 are shown on a side wall 78 of the tube carrying arm 40.

Figure 2:
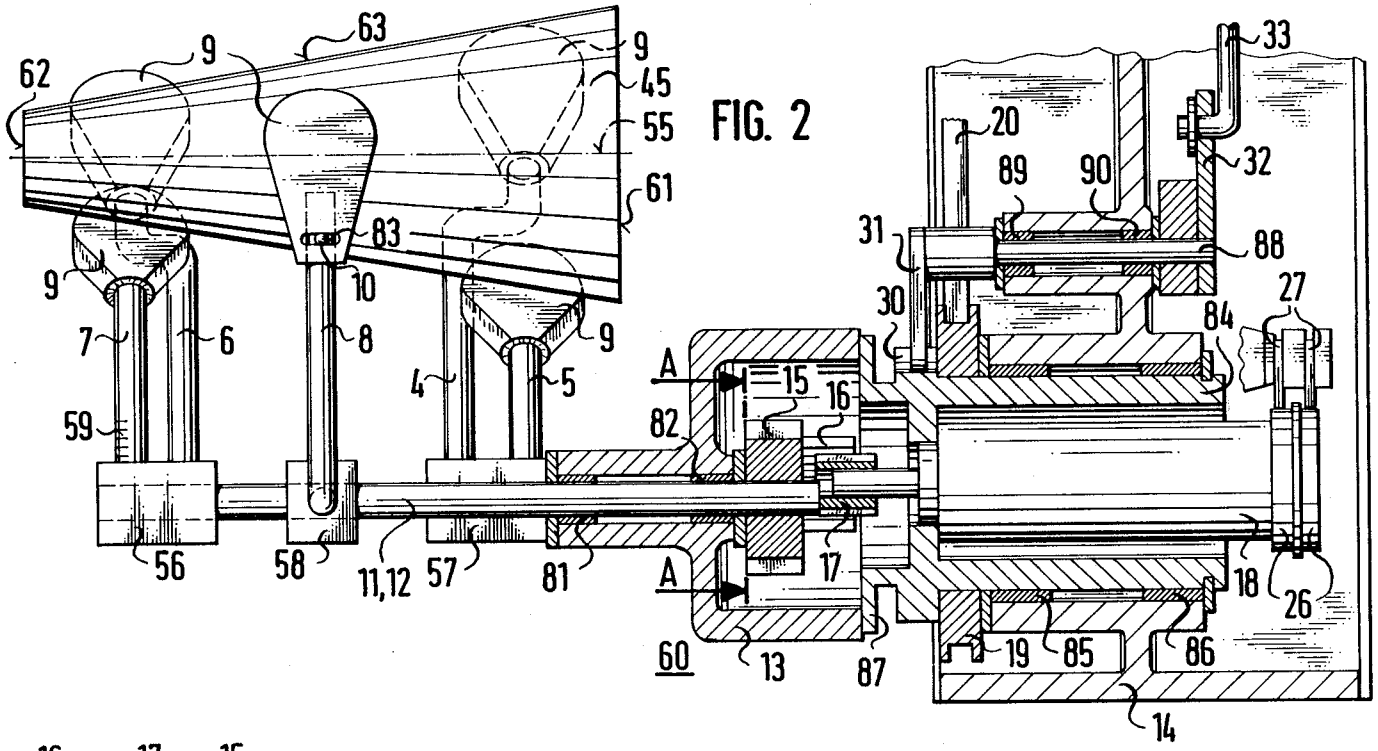
FIG. 2 is an enlarged, partially longitudinal-sectional view showing details of the feeder
Figure 2A:
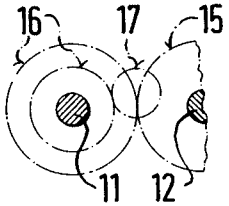
FIG. 2*a* is a cross-sectional view taken along the line A—A of FIG. 2, in the direction of the arrows.

FIG. 2 shows the feeder head 13 and actuating elements thereof in a longitudinal section. The feeder head 13 is rotatably supported in the feeder arm 14. The rotational movement of the feeder head 13 is initiated through a toothed belt drive 19 and 20. Finger shafts 11 and 12 are supported in the feeder head 13 by means of roller bearings 81, 82. Finger holders 56, 57, 58 are secured on the shafts 11, 12. The shaft 12 located at the front as seen in FIG. 2 supports the finger holder 58 for the finger 8 that is adjustably or longitudinally displaceably disposed in the holder 58. The shaft 11 supports the finger holders 56 and 57 for the pairs of fingers 6, 7 and 4, 5, respectively, which are likewise adjustable and longitudinally displaceable. The fingers are displaceable in the finger holders in accordance with graduations 59. The graduations are only shown on the finger 7. The fingers can be locked in the finger holders by means of non-illustrated clamping connections.

Finger tips 9 are supported on the fingers 4–8 in a limitedly pivotable manner for the tube 45 which has a longitudinal axis 55. As a result, they can be better adjusted to arbitrary tube conicities. Oblong slots 83 are provided in the finger tips and stop pins 10 that fit these slots are provided on the fingers 4–8, in order to limit the pivot angle of the fingers.

The pivoting motion of the fingers 4–8 is derived from a direct current motor 18 through gear wheel drives 15, 16, 17. Within these gear wheel drives, the wheels 15 and 16 mesh directly, so that a simultaneous contrary rotational motion of the shafts 11, 12 and thus the simultaneous opening and closing of the pairs of opposing fingers 4, 5; 6, 7 relative to the separate finger 8 is assured. The supply of current to the direct current motor 18 is effected through slip rings 26 and brushes 27 from a non-illustrated reversible current source.

The positional fixation of the feeder head 13 on the feeder arm 14 is assured with the aid of a pawl 31 and a rachet wheel 30. Detents 73 and 75 are present in the rachet wheel 30 as seen in FIG. 4.

Figure 3:
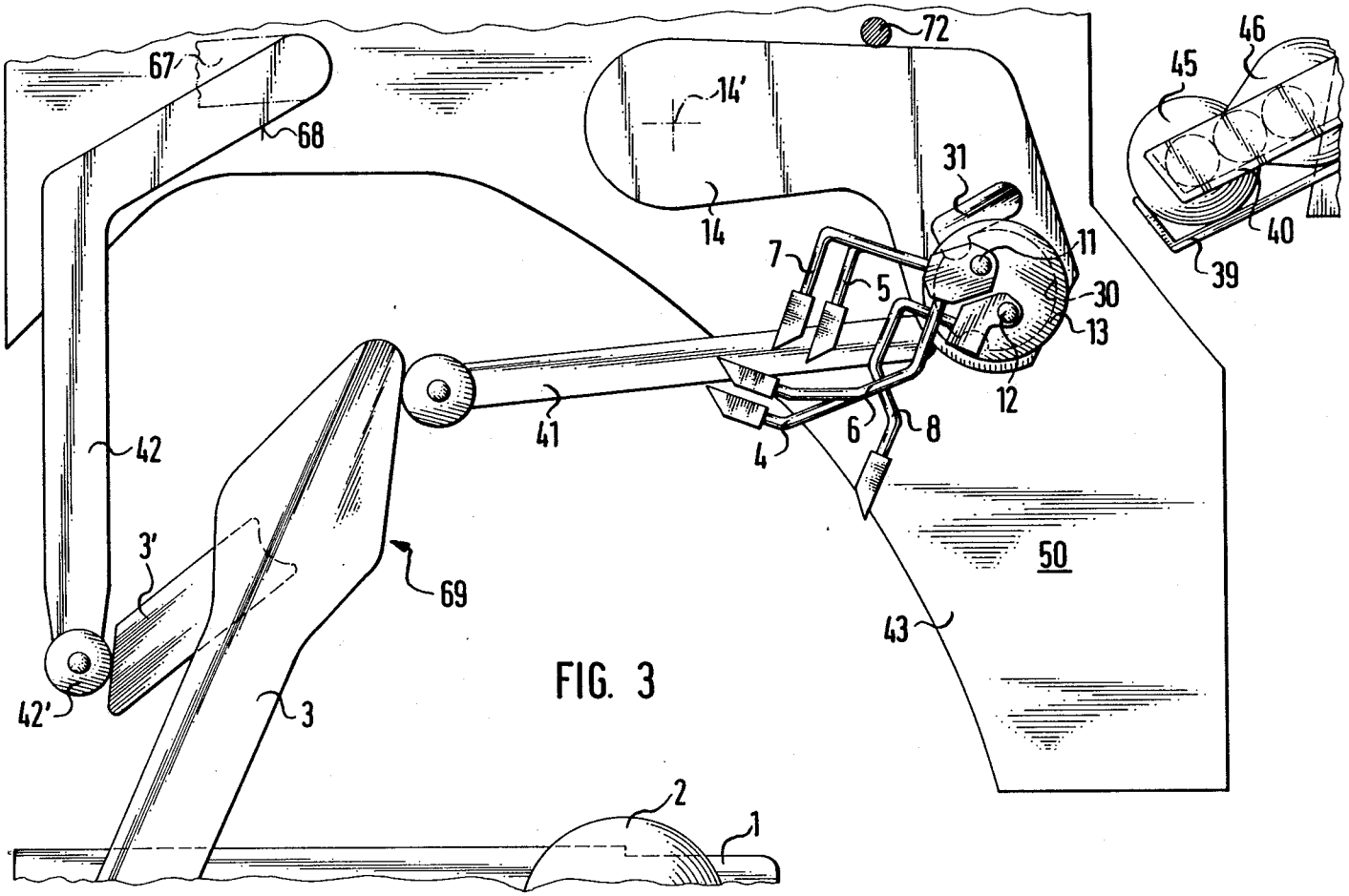
FIGS. 3–7 are views similar to FIG. 1 showing the apparatus in various positions.

FIG. 1 shows the feeder 60 in a zero, off or neutral position. Only one stop device, in the form of a creel erector or lifter 42, has been pivoted into the operating position from a position of repose or idle position 67 shown in FIG. 3. In FIG. 3, the feeder head 13 has already been pivoted counterclockwise through 90° into the receiving position. The pivoting motion is initiated by a non-illustrated central cam plate packet or set inside the cheese changer 50 and it is transferred through an actuating rod 25, an actuating lever 24 and a toothed quadrant 23 to a pinion 22 and a toothed belt wheel 21 connected thereto, as seen in FIG. 1. The pinion 22 is supported on the shaft of the toothed belt wheel 21 with the aid of a non-illustrated free-running wheel, so that the pivoting motion initiated through the toothed quadrant 23 becomes a rotational motion in the same direction of rotation. A tube 84 is supported in the feeder arm 14 by means of roller bearings 85, 86. This rotational motion is transferred to the tube 84 through the toothed belt 20 which is shown in FIG. 2, and through the toothed belt wheel 19 which is also shown in FIG. 2. The tube 84 ends in a flange ring 87 which is screwed to the feeder head 13.

Prior to the pivoting of the feeder head out of the position of repose of FIG. 1 into the receiving position of FIG. 3, the pawl 31 has been briefly lifted out of its detent through actuating elements 32, 33, 34 and 35, which are also supported in the feeder arm 14. The actuating element 32 is a lever which is secured on a shaft 88 of the pawl 31, as best seen in FIG. 2. The shaft 88 is supported by means of roller bearings 89, 90 in the feeder arm 14. The actuating element 33 is a shifter rod pivotably connected to the lever 32 and pivotably connected to a pivotable lever 34 as a further actuating element, as seen in FIG. 1. The lever 34 is connected to a further lever 35. These two levers 34, 35 have a common pivot axis 91. The motion likewise results from the rotational motion of a central cam plate packet or set, which is disposed inside the cheese changer. From there, the motion is carried further through a connecting rod 38. The connecting rod 38 imparts the motion to levers 37 and 36, which are disposed on a common shaft and have a common pivot axis 92. A roller 36' on the end of the lever 36 cooperates with the aforementioned lever 35.

After the feeder head 13 has rotated counterclockwise through a relatively small angle, the pawl 31 once again rests on the periphery of the rachet wheel 30 and after a rotational angle of approximately 90° it locks in place in the detent 73. In order to reliably assure the operating motion of the feeder head 13, the working stroke of the aforementioned cam plate is oversized.

During the pivoting motion of the feeder head 13, a creel raising device or creel lifter 41 also pivots out of its position of repose shown in FIG. 1 into the operating position shown in FIG. 3. A roller 41' of the creel lifter 41 acts upon the right arm of the creel 3. The creel 3 is raised by means of the creel lifter 41 to such an extent that the creel tilting lever 3' thereof is supported on the roller 42' of the creel erector 42, which has already been put into its operating position beforehand. However, since the creel lifter 41 still continues to move some distance, the creel 3 then must execute a pivoting motion about the pivot axis 53 shown in FIG. 6, causing the fastening axis 54 thereof to assume a horizontal position, regardless of the conicity for which the creel 3 has just been adjusted.

Stops are provided for the creel lifter 41 and the creel erector 42 for exact positional determination. These stops are located inside the machine frame 43 and therefore are not shown. The motions of the creel lifter 41 and the creel erector 42 are also derived by the aforementioned central cam plate packet or set, through non-illustrated lever configurations also disposed in the machine frame 43.

The two shafts 11 and 12 are then rotated contrary to one another out of the receiving position of FIG. 3, so that the fingers 4–8 close around the tube 45 located in a front tube storage position 65 of the tube magazine 51, as FIG. 4 shows. Being set into motion by the direct current motor, the shaft 11 rotates clockwise while the shaft 12 rotates counterclockwise, until the fingers have grasped the periphery of the tube 45 with a predetermined retaining force.

After the tube 45 in the tube magazine has been grasped, the feeder head 13 is unlatched, in the manner described above. The feeder head 13 then rotates counterclockwise once again, until it reaches the position shown in FIG. 5. The angle of rotation amounts to approximately 270°. In this process the tube 45 is lifted upward out of the tube magazine 51. The tube 46 therefore slips into the position of the tube 45, that is into the front tube storage position 65, as shown in FIG. 5.

Figure 5:
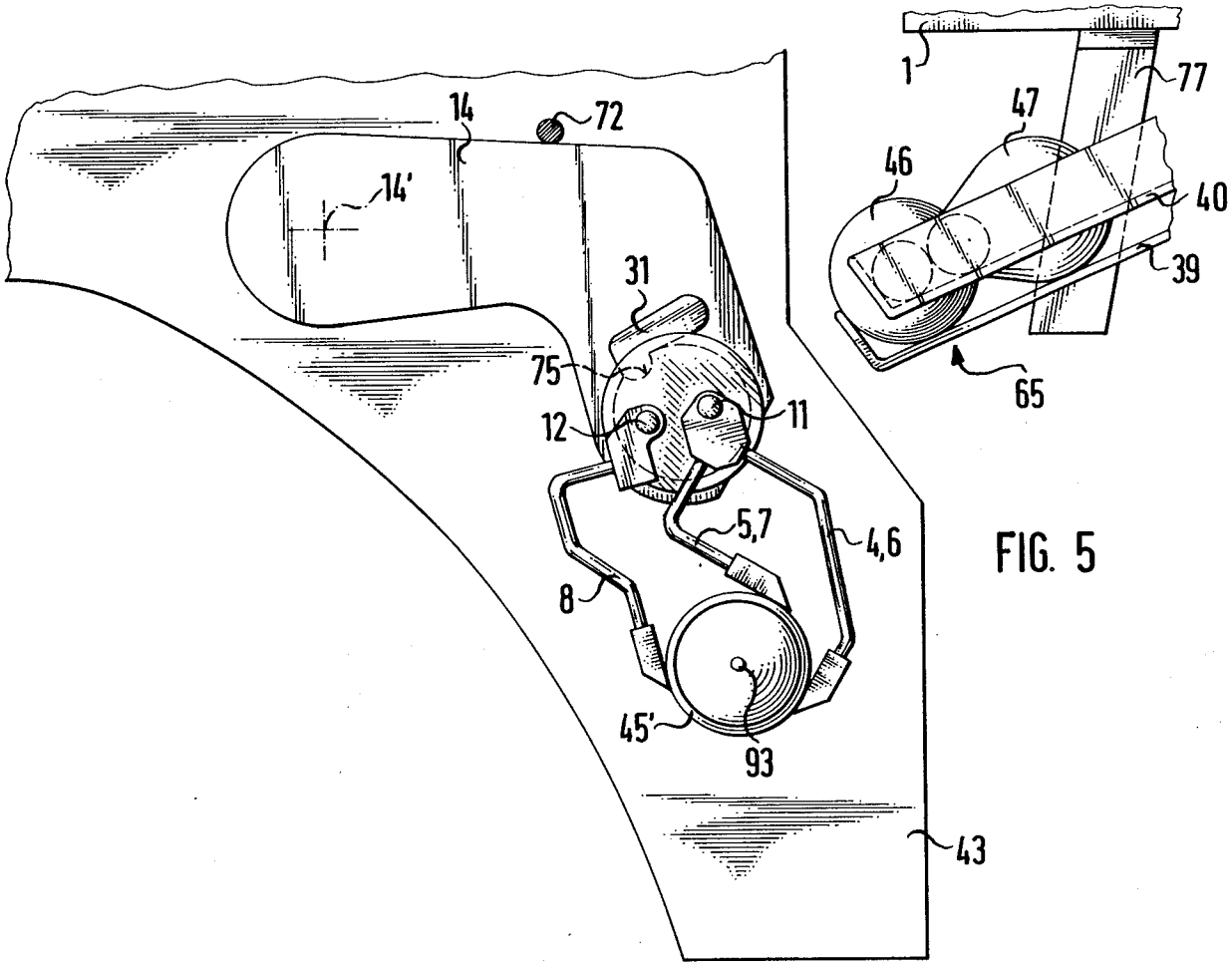

In order to indicate that the feeder 60 can also manipulate cylindrical tubes, FIG. 5 shows the retention of a cylindrical tube 45', having a longitudinal axis 93. FIG. 5 also shows an intermediate position suitable for forming a reserve winding.

Figure 8:
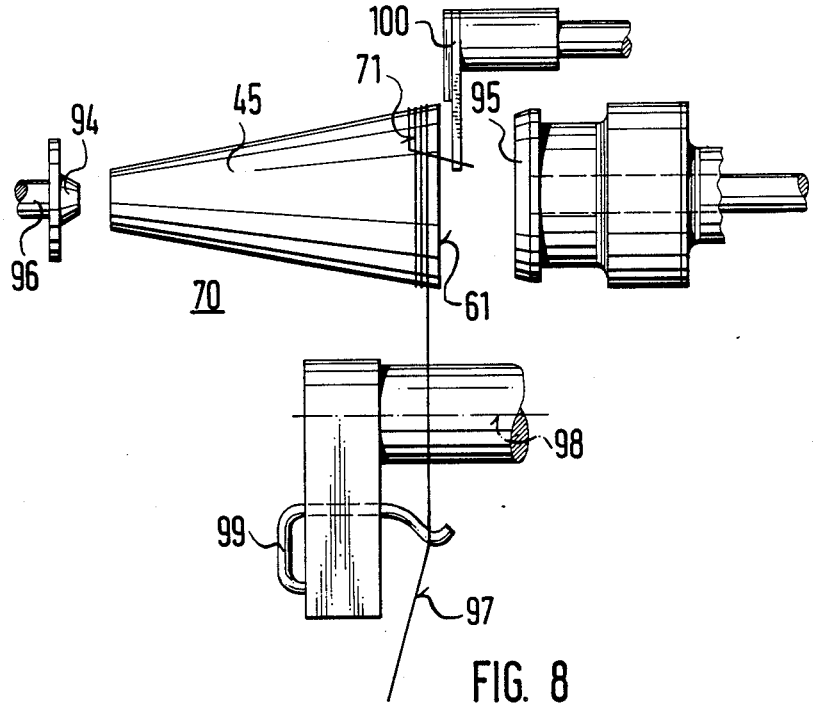
FIG. 8 is a side-elevational view of a device for forming a reserve winding on the tube end, that is part of the cheese changer.

FIG. 8 shows that the cheese changer 50 has a device 70 for forming a reserve winding 71 on the tube end 61 of the tube 45. The device 70 has two tube plates 94, 95 that are rotatably supported on the machine frame 43 and can be axially positioned with respect to the tube 45. A shaft 96 of the tube plate 94 is drivable by motor, so that the tube 45 is drivable during the formation of the reserve winding 71 by the device 70. Yarn or thread 97 is deflected outward toward the tube end or base 61 by means of a yarn guide device 99 that is displaceable along an axis 98. After the reserve winding 71 has been formed, the excess yarn end is cut off by controllable yarn remnant shears 100.

In order to assure the tube drive inside the reserve winding device 70, current fed to the direct current motor 18 is switched off after the closure of the rotatable tube plates 94, 95, in order to release the fingers 4-8 from the tube 45. After the winding of the yarn reserve 71 and prior to the opening of the tube plates 94, 95, the voltage supply to the direct current motor 18 is switched back on again. As a result the tube 45 is again grasped and firmly held by the fingers 4–8.

Figure 6:
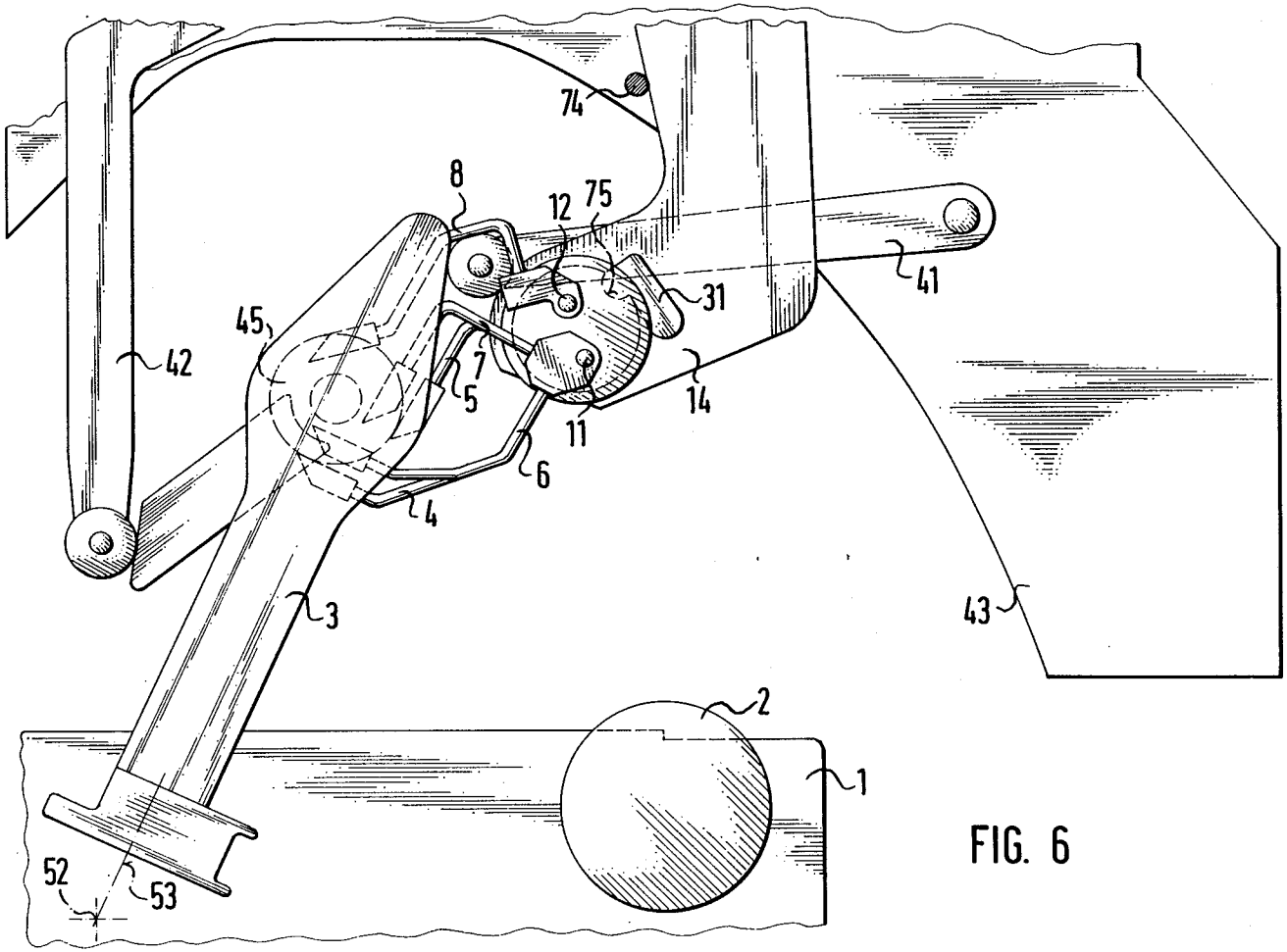

After the opening of the tube plates 94, 95 of the reserve winding device 70, the feeder arm 14 with the feeder head 13 fixed by the pawl 31, pivots into the position shown in FIG. 6. During this process the feeder arm 14 leaves a stop 72 shown in FIG. 5 and positions itself against a stop 74 shown by way of example in FIG. 6. FIG. 6 shows the feeder 60 in the tube releasing position. The creel 3 is opened. The pivoting motion of the feeder arm 14 from the position of FIG. 5 into the tube releasing position of FIG. 6 is also derived by the aforementioned central cam plate packet or set and is transmitted through a connecting rod 29 shown in FIG. 1 and an actuating lever 28 to the feeder arm 14 having the pivot axis 14'.

Figure 7:
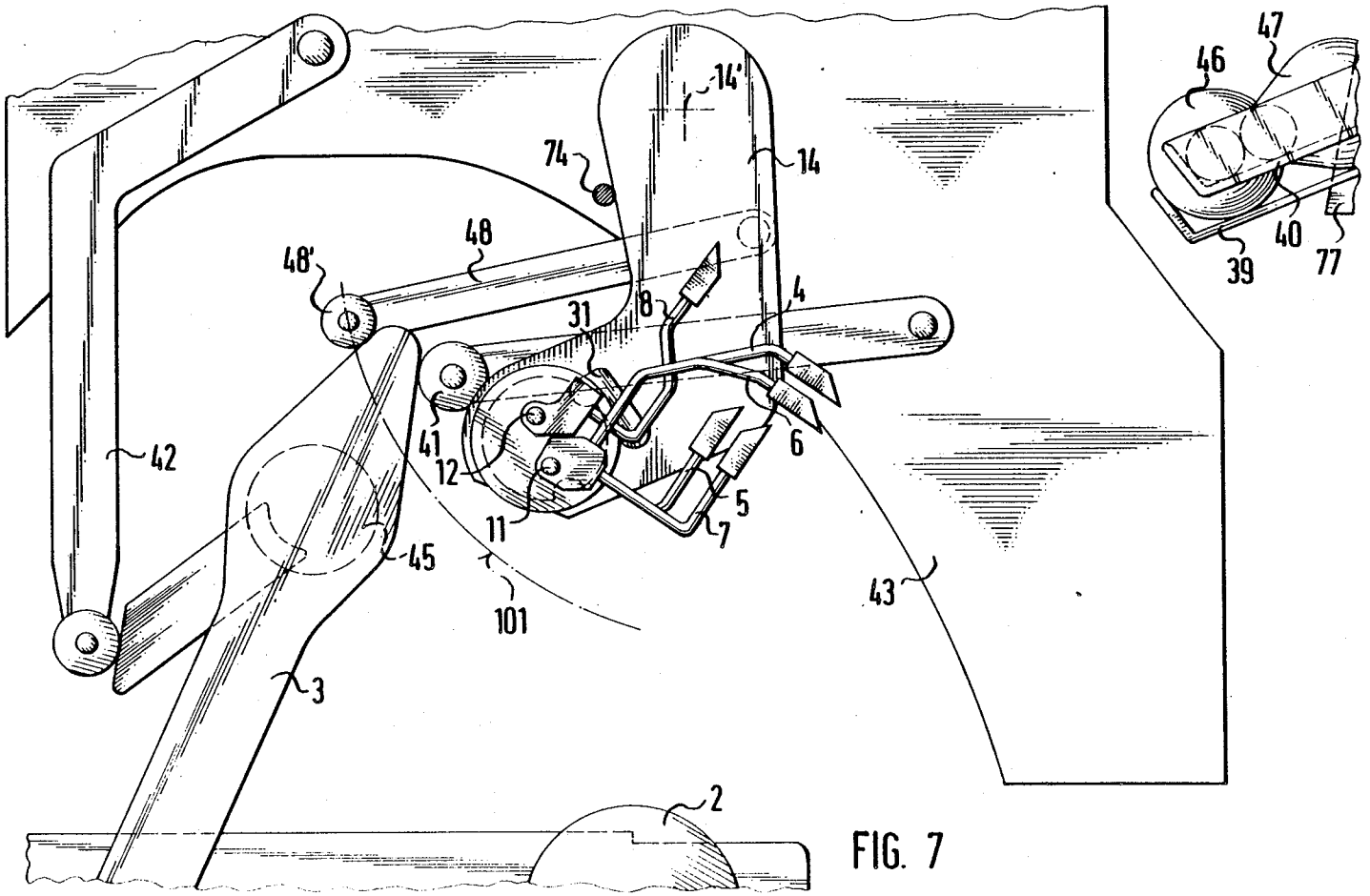

After the closure of the creel 3 in a conventional manner, the fingers 4–8 open by means of reversing the polarity of the direct current motor 18. As a result, the shafts 11 and 12 are rotated back into their starting position, during the course of which they take the fingers along with them. The opened position of the fingers 4–8 is shown in FIG. 7, wherein the tube 45 is diagrammatically shown in the creel 3. Suitable stops, which for example are present o the gear wheels connected to the shafts or on one of the gear wheels, fix the final position of the fingers 4–8. For the sake of clarity in the drawing, the stops have not been shown. The direct current motor 18 for actuating the fingers 4–8 is protected from overload by a motor protection switch, which is once again not shown.

After the tube 45 is fastened into the creel 3, the feeder arm 14 moves back to its starting position shown, for example, in FIG. 1. The creel 3 is then lowered by a pressing roller 48' of a pressing lever 48. The roller 48' follows a circular path 101 indicated in FIG. 7. The pressing lever 48 and the roller 48' are constructed in such a way that in order to begin winding, they can press the creel 3 down until it rests on the winding drum 2. Suitably, in the position for beginning winding, the motion of the cam packet or set is stopped and after a variable period of time has elapsed it is started again, so that there is sufficient time for winding to be begun satisfactorily. Once the cam plate packet or set has been restarted, the pressing lever 48 and the creel erector 42 then pivot back into their zero or neutral positions. The cheese changer 50 then records the completed cheese change for the winding apparatus 1 and leaves that winding station, optionally in order to work at some other winding station of the same automatic winding machine or cheese-producing machine.

I claim:

1. In a cheese or cross-wound bobbin producing machine having winding stations with creels, an assembly comprising a tube magazine and an apparatus disposed on a movable service carriage for removing a tube from said tube magazine and transferring the tube to a creel, said apparatus including a feeder having individual fingers being mutually spaced apart along the longitudinal axis of the tube, means for encompassing the tube between said individual fingers, means for moving said individual fingers transversely to the longitudinal axis of the tube, means for moving said individual fingers between said tube magazine and the creel, and a cheese changer having a device for forming a reserve winding on a tube end, and said feeder having a detent for holding said individual fingers in a tube receiving position, and a detent for holding said individual fingers in a tube releasing position, and a detent for holding said individual fingers in an intermediate position for forming a reserve winding, said tube encompassing means opening and subsequently closing said individual fingers in said intermediate position.

2. Assembly according to claim 1, wherein said individual fingers include at least one separate finger and opposing fingers associated with said at least one separate finger.

3. Assembly according to claim 1, wherein the tube has head and base portions, and at least one of said individual fingers is associated with the head portion and at least one of said individual fingers is associated with the base portion of the tube.

4. Assembly according to claim 1, including finger holders in which said individual fingers are inserted, and means for permitting longitudinal displacement and locking of said individual fingers in said finger holders.

5. Assembly according to claim 1, wherein said individual fingers have a graduation thereon relating to at least one of tube diameter values and tube conicities.

6. Assembly according to claim 1, including two oppositely rotatable finger shafts on which said individual fingers are disposed in groups, a feeder head in which said finger shafts are supported, and a pivotable feeder arm of said feeder in which said feeder head is rotatably supported.

7. Assembly according to claim 6, wherein the tube has a base, a head and a middle portion, said individual fingers include two pairs of fingers respectively facing one another transversely to the longitudinal axis of the tube and at least one other finger, said two pairs of fingers being disposed on one of said two finger shafts for encompassing the tube at the tube base and at the tube head from one side, and said at least one other finger being disposed on the other of said two finger shafts for encompassing the middle portion of the tube from the opposite side.

8. Assembly according to claim 1, including articulating finger tips disposed on said individual fingers.

9. Assembly according to claim 8, wherein said finger tips have bowl-like shapes.

10. Assembly according to claim 1, wherein said tube magazine includes two mutually spaced apart tube carrying arms defining storage positions including a front tube storage position, said transverse moving means imparting a path of motion to at least one of said individual fingers of said feeder extending upwardly past said tube carrying arms through said front tube storage position.

11. Assembly according to claim 10, including means for adjusting at least one of said two tube carrying arms of said tube magazine to place at least a tube in said front tube storage position in a predetermined axial position, regardless of whether the tube is cylindrical or has a conicity.

12. Assembly according to claim 11, wherein said adjusting means includes an adjusting scale for at least one of said tube carrying arms being calibrated for at least one of tube diameter and tube conicity.

13. Assembly according to claim 1, wherein said cheese changer has a creel raising device.

14. Assembly according to claim 1, wherein said cheese changer has a creel lowering device.

15. Assembly according to claim 1, wherein said cheese changer has a creel raising device and a creel lowering device.

16. Assembly according to claim 13, wherein the creel has two arms, said apparatus includes a cheese changer having a creel raising device for raising the creel into a tube receiving position, a stop device for the creel movable between a position of repose and an operating position, and a creel tilting lever for one of the arms of the creel to be pressed against said stop device.

17. Assembly according to claim 11, including finger holders in which said individual fingers are inserted, and means for permitting longitudinal displacement and locking of said individual fingers in said finger holders with said individual fingers being inserted and locked in said finger holders with the longitudinal axis of the tube received and retained by said feeder and said axial position of the tube predetermined by said tube magazine extending parallel to one another.

18. Assembly according to claim 11, wherein said apparatus includes a cheese changer having a device for forming a reserve winding on a tube end, and said feeder has a detent for holding said individual fingers in a tube receiving position, and a detent for holding said individual fingers in a tube releasing position, and a detent for holding said individual fingers in an intermediate position for forming a reserve winding, and said tube encompassing means opens and subsequently closes said individual fingers in said intermediate position, said device for forming a reserve winding having a longitudinal axis, and said longitudinal axis of said device for forming a reserve winding and said axial position of the tube predetermined by said tube magazine extending parallel to one another.

19. Assembly according to claim 11, wherein the creel has a fastening axis in said tube receiving portion, and said fastening axis and said axial position predetermined by said tube magazine extend parallel to one another.

20. Assembly according to claim 18, wherein the creel has a fastening axis in said tube receiving position, and said fastening axis and said longitudinal axis of said device for forming a reserve winding extend parallel to one another.

21. Assembly according to claim 17, wherein the creel has a fastening axis in said tube receiving position, and said fastening axis and said longitudinal axis of the tube predetermined by said feeder extend parallel to one another.

22. Assembly according to claim 8, wherein said finger tips have plate-like shapes.

23. Assembly according to claim 8, wherein said finger tips have dish-like shapes.

* * * * *